US006076212A

United States Patent [19]

Feld

[11] Patent Number: 6,076,212

[45] **Date of Patent: *Jun. 20, 2000**

[54] SAFETY DEVICE FOR STEEL BED RAIL

[76] Inventor: Mark Feld, 6105 Benhurst, Baltimore, Md. 21209

[ * ] Notice: This patent is subject to a terminal disclaimer.

[21] Appl. No.: 09/245,590

[22] Filed: Feb. 8, 1999

Related U.S. Application Data

[63] Continuation-in-part of application No. 08/839,396, Apr. 11, 1997, Pat. No. 5,867,853.

[51] Int. Cl.[7] ..... A47C 21/00

[52] U.S. Cl. ..... 5/663; 5/424

[58] Field of Search ..... 5/663, 424, 200.1; 248/345.1

[56] References Cited

U.S. PATENT DOCUMENTS

| | | | |
|---|---|---|---|
| 2,564,386 | 8/1951 | Webb | 5/663 |
| 2,600,556 | 6/1952 | Malm | 5/663 |
| 2,636,189 | 4/1953 | Feldman | 5/663 |
| 2,951,252 | 9/1960 | Roche | 5/663 |
| 3,546,725 | 12/1970 | Tambascio | 5/663 |
| 4,109,887 | 8/1978 | Wakeland, Jr. et al. | 5/663 |
| 4,514,871 | 5/1985 | Fisher et al. | 5/663 |
| 4,710,992 | 12/1987 | Falwell et al. | 5/663 |
| 5,331,696 | 7/1994 | Armstrong et al. | 5/663 |
| 5,867,853 | 2/1999 | Feld | 5/663 |

*Primary Examiner*—Alexander Grosz

*Attorney, Agent, or Firm*—Angenehm Law Firm, Ltd.; N. Paul Friederichs, II

[57] ABSTRACT

An L-shaped steel rail of a bed frame, having a top edge and a face surface; a protective member being disposed at least in part above the top edge of the steel rail, the protective member being designed of a compressible material suitable for spreading a force of impact, the member minimizing damage to an object impacting against the top edge of the steel rail, and the protective member minimizing damage to an object impacting against the face surface; and mechanism for attaching the protective member to the steel rail and a method of use including the steps of providing a steel rail of a bed frame, having a top edge and a face surface; and shielding the steel rail, minimizing a force of impact between an object and the steel rail.

19 Claims, 2 Drawing Sheets

SAFETY DEVICE FOR STEEL BED RAIL

This application is a Continuation-In-Part of Ser. No. 08/839,396, filed Apr. 11, 1997, resulting in U.S. Pat. No. 5,867,853.

BACKGROUND OF THE INVENTION

1. Field of the Invention

The field of the present invention relates generally to attachments or accessories to beds, more particularly to attachments adapted to cover or protect a rail or frame portion of a bed and most specifically such attachments adapted to provide a cushion for an L-shaped steel rail including a portion of a bed frame.

2. General Background

Historically bed frames are considered generally to have been made from wood. The utilization of steel in bed construction was perhaps first known and widely practiced in the manufacture of springs in a box frame which is commonly known as box springs. Head and foot boards, as the terms connote, were and still preferably are, made from wood. Neither box springs nor head nor foot boards, however, are considered to be components of a typical, modern, bed frame. Box springs are considered to be separate from a bed frame though typically disposed directly upon the frame, and both head and foot boards, though historically a part of a wooden bed frame, are unnecessary to a steel bed frame which typically lacks both. Brass bed frames, though quite popular earlier in this century, are considered fairly uncommon today and bed frame construction currently is considered to be predominantly in steel despite this practice being relatively recent.

Modern bed frames of steel construction are further considered typified by the use of a pair of substantially parallel, spaced apart, L-shaped steel side rails typically attached to a pair of L-shaped steel cross rails to which a pair of feet is attached. While both pairs of steel rails are typically constructed from an L-shaped length of steel possessing a corner from which two legs extend perpendicularly, each leg having a free edge longitudinally parallel to the other. The side rails are invariably oriented upward and the cross rails typically oriented downward. Upward and downward in this case is understood to connote the direction of a vertical leg in relation to the corner of the rail with the other leg disposed horizontally.

The side rails are further considered to be generally oriented upward in a modern type steel bed frame of typical construction in order to provide, at the minimum of expense in construction, lateral positioning of the box spring disposed therebetween thus ensuring that the box spring remains immobile with respect to the bed frame. The box springs rest upon the upper surface of the horizontal, inward oriented, legs of the side rails and the cross rails are attached to the lower surface of the same. The cross rails are oriented downward in this construction with the upper surface of the horizontal legs flush with the lower surface of the horizontal legs of the side rails. The legs, furthermore, are typically attached to the vertical legs of the cross rails which, for this reason also, should be oriented downward. This arrangement is considered to be the most economic and the most common construction of bed frames known at present.

It is also noted that, historically, beds commonly possessed greater height than that which is common today. Heat was relatively more expensive in centuries past and sleeping closer to the floor, where it was colder, was undesirable. Today residential ceilings are commonly only nine feet high or less whereas a century ago ceilings were commonly twelve feet high or more. With relatively lower energy costs and newer technology such as central heating and air conditioning, it is more economic to build residential structures with relatively low ceilings and to build beds which are lower to the ground than the equivalent historical structures. A bed construction which is lower to the ground than another construction is more economic to manufacture than the other. The structure, having less height, requires less material, obviously, and the structure itself may be made of lighter gauge material since a lower structure of the same gauge material is inherently more stable than the higher structure.

DISCUSSION OF THE PRIOR ART

Historically bed frames have been constructed of wood and this is inclusive of cribs for infants. In order to prevent injury from teething infants to the rail, U.S. Pat. No. 2,564,386 issued to Webb and U.S. Pat. No. 2,636,189 issued to Feldman both disclose a plastic covering for the top of a wooden rail each quite similarly formed of an extruded configuration possessing a barbed protrusion extending inwardly from the device inserted into a longitudinal groove in the wooden rail. Webb discloses use of two opposed lateral barbed protrusions and Feldman discloses use of a single central barbed protrusion extending downward together with lateral legs resiliently exerting pressure inward upon the rail.

Waterbed frames are still, invariably, constructed of wood. This is considered to be essentially needed as the most economic construction viable for a mattress filled with a fluid reservoir held within a fluid impermeable flexible bladder. It is considered that the frame for such a mattress should possess an elevation equal to the uppermost height of the mattress under a loaded condition and therefore an elevation substantially superior to the mattress in an unloaded condition. The upper exterior edge of the side rails of the frame, which invariably consist of either two by ten inch or two by eight inch lengths of lumber, are hence exposed. Because of the enormous weight involved, waterbeds are also invariably rather low to the floor in comparison with most other types of beds. For both of these reasons, the upper exterior edges of waterbed frames are commonly hit by one's shins and many disclosures are known which are concerned with this problem.

U.S. Pat. No. 4,109,887 issued to Wakeland for a 'Waterbed Retainer Cap' is an example. Waterbeds commonly use a liner which is attached interiorly to the bed frame and this provides the primary concern typical to these disclosures. Use of foam cushioning in conjunction with a structure which will readily attach to the upper edge of a two-inch nominal, one and seven-eighths inch actual, thick lengths of lumber and which will also secure a liner to this frame are typical characteristics of these disclosures.

With regard to metal bed frames, i.e., modern type steel bed frames, however, only two pertinent references are known which describe attachments to L-shaped rails. U.S. Pat. No. 2,951,252 issued to Roche for a 'Bedframe Side Rail End Cap' discloses a thin walled plastic cover for the end of an L-shaped steel rail of the type typically utilized in bed frame construction which was intended to prevent one from snagging clothing or otherwise incurring damage to clothing from contact with the then exposed and commonly sawed off ends of the steel rail of a bed frame.

Another device, though unconcerned with safety, utilized specifically in association with an L-shaped steel side rail of a bed, is disclosed by U.S. Pat. No. 3,546,725 issued to Tambascio for a 'Bedframe with Decorative Trim Strip' which provides for concealment of the outer face of the rail with a device which clips upon the upward member of the rail and which depends downward therefrom, covering the entire outward face of the rail for aesthetic purposes only.

Statement of Need

The increasingly common construction of beds utilizing a pair of L-shaped steel rails as described above, in conjunction with construction of beds which are relatively low in comparison with historical norms, is considered in combination to present a significant safety hazard which has been wholly overlooked. Because each steel rail is relatively thin, approximately eleven hundredths of an inch (typically 0.109") in thickness, and because the top edge of each side rail is typically disposed at an elevation within a few feet of the floor, it is a common place for children to injure themselves in an accidental collision with a steel bed side rail, particularly the top edge of the same.

The National Injury Information Clearinghouse, a division of the U.S. Consumer Product Safety Commission (CPSC), has collected thousands of reports of injury related to metal, i.e., modern type steel, bed frames. These statistics have been compiled from accident investigation reports, consumer complaints, death certificates and the National Electronic Injury Surveillance System (NEISS).

From this information it is seen that injuries resulting from accidental collision with modern type steel bed frames most commonly involve the legs and head and that these injuries range in severity from lacerations and contusions to dislocations and fractures. Extrapolation of these NEISS data in the 'Product Summary Report,' U.S. CPSC, 1995, yields an estimation of the total number of injuries related to bed frames and bed springs as exceeding 50,000 annually in the United States.

Because of the number and severity of injuries resulting from accidental collision with a modern type steel bed frame, particularly the upward facing member or leg of a steel rail of a bed frame, a need exists for a safety device specifically adapted to and readily deployed upon such a rail of an existing bed frame which will lessen the incidence and severity of these injuries.

SUMMARY OF THE INVENTION

Objects of the Invention

The encompassing object of the present invention is the provision of a device which will effect a reduction in the incidence and severity of injury resulting from accidental collision with an L-shaped steel rail of a bed frame.

The primary object of the present invention is the provision of a device which will effect a reduction in the incidence and severity of injury resulting from accidental collision with the vertical leg of an L-shaped steel rail of a bed frame.

A first auxiliary object of the present invention is the provision of a device which will effect a reduction in the incidence and severity of injury resulting from accidental collision with the upper edge of the vertical leg of an L-shaped steel bed side rail.

A secondary auxiliary object of the present invention is the provision of a device which will effect a reduction in the incidence and severity of injury resulting from accidental collision with the outward face of an L-shaped steel rail of a bed frame.

A third auxiliary object of the present invention is the provision of a device which will effect a reduction in the incidence and severity of injury resulting from accidental collision with the exterior corner of an L-shaped steel rail of a bed frame.

An ancillary object of the present invention is the provision of a device which will effect a reduction in the incidence and severity of injury resulting from accidental collision with an L-shaped steel rail of a bed frame which is easily attached to a standing bed.

A second ancillary object of the present invention is the provision of a device which will effect a reduction in the incidence and severity of injury resulting from accidental collision with an L-shaped steel rail which is easily attached to but not easily removed from a standing bed.

A third ancillary object of the present invention is the provision of a device which will effect a reduction in the incidence and severity of injury resulting from accidental collision with an L-shaped steel rail which is easily attached to said rail during manufacture.

Other ancillary objects of the present invention include the provision of a device which will effect a reduction in the incidence and severity of injury resulting from accidental collision with an L-shaped steel rail which is economic, which is non-toxic, and which is otherwise safe to children and others.

Principles Relating to the Present Invention

It is first recognized that the present invention is concerned primarily with safety. While it is generally a benefit to present an aesthetically pleasing appearance, a structure in accordance with the principles relating to the present invention effectively reduces the incidence and severity of injury resulting from collision with an L-shaped steel rail of a bed frame. Hence a cushion which may readily be attached to an L-shaped steel rail is suggested. Such a cushion preferrably possesses satisfactory physical characteristics with regard to the absorption of impact and also with respect to attachment to the rail.

A typical L-shaped steel rail of a bed frame, as mentioned earlier, possesses two legs extending perpendicularly from a common corner, including what is hereinafter known as an exterior corner, which each terminates in a longitudinal edge substantially parallel to and spaced diagonally apartfrom each other. Furthermore, current construction of metal frame beds utilizes a pair of L-shaped steel side rails disposed substantially parallel to and spaced apart from each other with each said side rail oriented such that one leg is horizontal with one edge directed inward and the other leg is vertical with an edge, known hereinafter as the top edge, directed upward. The exterior corner of the rail has a bottom edge of the substantially smooth, flat, vertical face, known hereinafter as an outward face, which is between the side rail top and bottom edges.

As set forth in the objects of the present invention, it is considered desirable to cushion the entire exposed structure of an L-shaped steel rail of a bed frame. This exposed area includes the top edge, the exterior corner, and the outward face therebetween. The top edge is considered the most important portion with regard to the need for sufficient cushioning for two reasons. It is considered the most likely portion of the rail with which to collide in a fall, for one. Secondly, it is considered the most potentially injurious portion of the rail in a collision because it presents the sharpest contact area. As mentioned earlier, the thickness of a leg of a typical L-shaped steel rail of a bed frame is approximately eleven hundredths of an inch (0.11"). And the top edge possesses an effective width which varies but which is generally less than the thickness of the leg.

In order to provide adequate cushioning of the top edge of an L-shaped steel bed side rail an appropriate material of good impact absorption characteristics is preferred. Impact absorption is considered a complex characteristic because standard units are lacking in common usage. However, impact absorption includes compression and is related to the kinetic energy absorbed during compression. Resilience is further recognized as desirable. A material with good impact absorption characteristics is hence one which readily absorbs energy during compression, preferably further possessing a recovery of over ninety-five per cent. The most preferred aspect of construction may be sufficient thickness of the material used exteriorly adjacent to and above the top edge of the rail; over twice the thickness of the rail leg, or at least a quarter of an inch, is preferred and three-eighths of an inch or more is recommended. A commensurate though lesser degree of cushioning is desired for the exterior corner of a side rail and for the outward face of the rail.

With regard to satisfactory attachment of a safety device in accordance with the principles relating to the present invention to a typical L-shaped steel bed side rail to an already standing bed it is considered that, because of the degree of cushioning preferred above the top edge of the rail, location upon this top edge is preferred and that an abutment surface through which the top portion of the device makes contact with the top edge of the vertical leg is further preferred for proper location of what is considered a useful cushioning structure of the device. While adhesive may further be used to fix the disposition of the device to the rail proper positioning of the device demands an abutment surface which can be placed onto the top edge of the vertical leg and with which proper location of the device with respect to this free edge may be readily effected. In this case both the adhesive and the abutment surface together provide the mechanism of attachment.

With regard to satisfactory attachment of a safety device in accordance with the principles relating to the present invention to a typical L-shaped steel bed side rail during manufacture of the bed frame it is considered that the device may be molded onto the rail such that the width of the vertical leg and the top edge of the same determines the width, shape, and texture of the abutment surface. Given the superior attachment characteristics obtained with this approach and the recognition that no cushioning is desired interior to this vertical leg it is considered that an interior portion may be purely incidental to providing positioning of the top portion above the top edge.

It is further recognized that a device in accordance with the principles relating to the present invention does not require significant variation in configuration longitudinally and that extrusion of a suitably resilient material is considered to be an economic manner of manufacture of such a device which may be located upon the vertical leg of an L-shaped rail of a standing bed as well as disposed thereon during manufacture of the frame. Molding the device directly upon the rail during manufacture of the frame is another approach which is considered economic. Dip molding of the rail into a bath of suitable liquid adhesive material such as natural latex rubber is suggested, particularly with disposition of the rail after immersion in the bath during solidification which promotes accumulation of material under the influence of gravity along the top edge of the rail primarily and the bottom edge secondarily.

Variations and other aspects of the preferred embodiments of the principles relating to the present invention will be readily appreciated with a reading of the detailed description following particularly if conducted with reference to the drawings attached hereto.

DETAILED DESCRIPTION OF THE PREFERRED EMBODIMENTS

The present invention is a safety device 20, which shields an object such as a person or item which may be damaged should it sharply strike the rail 10. The shielding may be performed via a deflector and/or a cushioning compressible barrier, such as safety device 20, or other such member or method that reduces or minimizes the severity of the blow between the object and the rail 10. This safety device 20 may or may not be secured to the rail 10 and may or may not be permanently secured to the rail 10. Preferably the cushioning spreads the force of the blow over a significantly larger area than would otherwise occur should the safety device 20 not be in place thereby minimizing damage to any object directly or indirectly contacting the rail 10. Significance of the larger area is determined in view of the ability of the larger area to minimize or eliminate the damage to an object striking rail 10.

Figure 1:
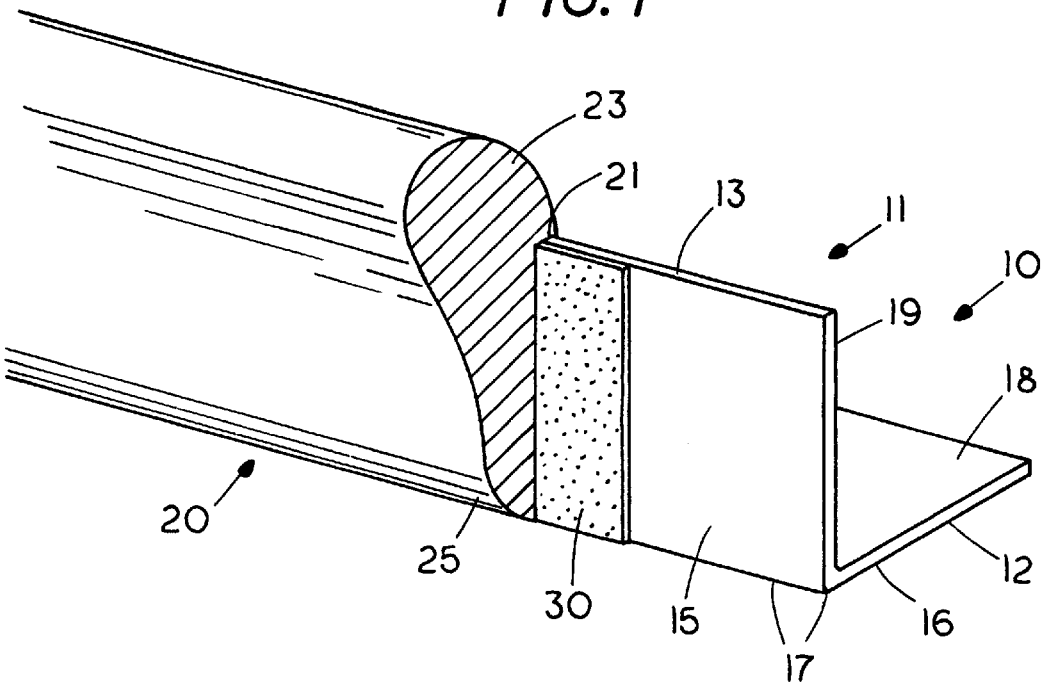
FIG. 1 is an isometric view of an L-shaped steel rail oriented as typical in use as a side rail of a modern steel bed frame with an embodiment of the principles relating to the present invention attached thereto, further shown in sectionally relieved view.
Figure 2:
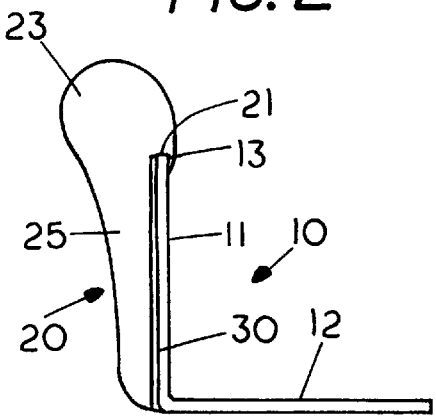
FIG. 2 is a cross sectional view of the rail and the embodiment of the principles relating to the present invention attached thereto depicted in FIG. 1.

FIG. 1 depicts an L-shaped steel rail 11 which, in the disposition invariably obtained when utilized as a longitudinal frame member of a modern type steel bed frame, possesses, as shown therein, a vertical leg 11 and a horizontal leg 12. The vertical leg 11 has a top edge 13 and an outward face 15 which may both be wholly covered and cushioned by a safety device 20 in accordance with the principles relating to the present invention which, as also seen in FIG. 2, possesses: (1) a top portion 23 shown above the top edge 13 of the rail 10; (2) an exterior portion 25 located adjacent the outward face 15 of the vertical leg 11; and (3) mechanism of attachment to the rail 10 including, in this case, a layer of adhesive 30.

In the particular case depicted in FIGS. 1 & 2 the top portion 23 has a substantially horizontal abutment surface 21 which contacts the top edge 13 of the vertical leg 11. This abutment surface 21 may be of negligible value in securing the safety device 20 to the L-shaped steel rail 10, which is effected with the adhesive layer 30, but is considered preferred for locating the safety device 20 properly upon the L-shaped steel rail 10 such that the top portion 23 is located above the top edge 13 and hence is considered preferable for attachment. The top edge 13, as mentioned earlier, presents the greatest hazard both with regard to likelihood and severity of injury and for this reason the top portion 23 may be the thickest portion of the safety device 20. It is further commented that the embodiment of the principles relating to the present invention depicted in FIGS. 1 & 2 is considered to possess a relatively simple configuration which is well suited to manufacture by extrusion. As shown in FIG. 2 a foam rubber or plastic is suggested as an appropriate material for extrusion.

Figure 3:
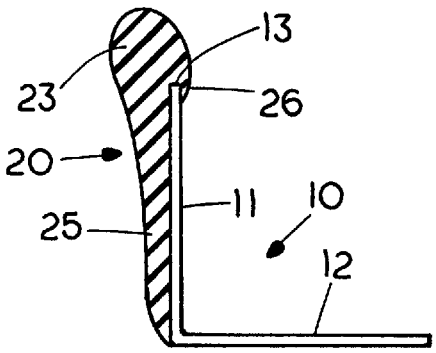
FIG. 3 is a cross sectional view of a first embodiment of the principles relating to the present invention similar in configuration to the embodiment depicted in FIGS. 1 & 2 achieved by dip molding.

A similar configuration is seen in FIG. 3 although dip molding is utilized to obtain the same wherein an L-shaped steel rail 10 is dipped into a bath of suitable liquid elastic material such as natural rubber and allowed to solidify with the rail 10 disposed top edge 13 down so that gravity will cause the liquid elastic material adhered to the rail 10 to migrate toward and accumulate below the inverted top edge 13 so that when the rail 10 is used in a bed frame the top portion 23 above the now upright vertical leg 11 is of substantial thickness sufficient to reduce the severity and incidence of injury in accidental collisions.

It is observed that the overall configuration of the safety device depicted in FIG. 3 is similar to that depicted in FIGS. 1 & 2 but that owing to the different method of manufacture an interior portion 26 interiorly adjacent the inward face 19 of the vertical leg 11 of minimal thickness and length or height is observed. It is generally considered desirable to minimize both the thickness and the length of the interior portion 26 because box springs are typically disposed within the interior of the L-shaped steel rail 10 resting upon the upper face 18 of the horizontal leg 12 and excessive thickness of the interior portion 26 particularly proximate the horizontal leg 12 may impose difficulties in installation upon the L-shaped steel rail 10 of an already standing bed. This point is largely moot in the particular case depicted in FIG. 3 because dip molding typically requires attachment of the safety device 20 prior to assembly of the bed frame but it is still recognized that the interior portion 26 does not actually provide protection against injury and it is therefore best minimized in the interest of economy.

As best seen in FIG. 3, the exterior portion 25 is smaller in thickness than the top or upper portion 23, and the exterior portion 25 is larger in thickness than the interior portion 26.

Figure 4:
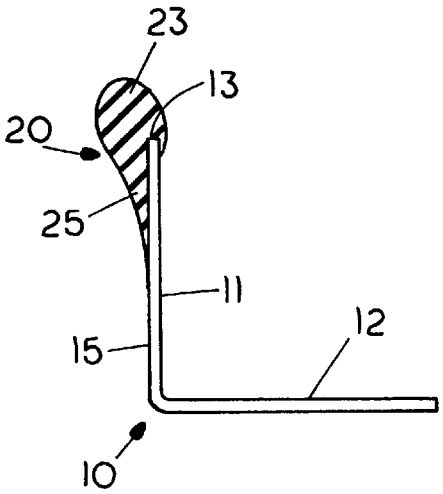
FIG. 4 is a cross sectional view of a second embodiment of the principles relating to the present invention which provides additional cushioning only to the top edge of the vertical leg of the rail.

The most economic manufacture with regard to the material utilized is perhaps expressed in FIG. 4 wherein it is seen that the safety device 20 includes a veritable drip of substantial thickness in the top portion proximate to and formed as pendent from the top edge 13 in a dip molding operation which likely requires considerable repetition. It is considered that an extruded form, even of many times as much cross sectional area such as that depicted in FIGS. 6 & 7, will likely be more economic than dip molding because extrusions are produced in many linear feet, regardless of the configuration considered, in the time that would be needed to dip mold the safety device 20 onto the L-shaped steel rail 10. The advantage to dip molding is considered to lie in the superior attachment obtained in comparison with that available to an extruded safety device 20. A layer of adhesive 30, as depicted in FIG. 2, can always be utilized, however, to fixedly attach the safety device 20 to the vertical leg 11.

Figure 5:
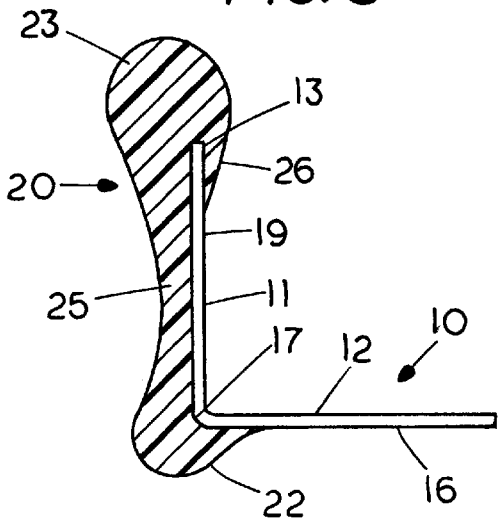
FIG. 5 is a cross sectional view of a third embodiment of the principles relating to the present invention which provides additional cushioning to both the bottom and top edges of the vertical leg of the rail.

FIG. 5 depicts what is considered, therefore, a relatively uneconomic embodiment of the principles relating to the present invention but one which presents certain benefits. Not only is the top edge 13 of the vertical leg 11 cushioned, as in all cases, and not only is the outward face 15 of the same 11 cushioned, as in all cases except that depicted in FIG. 4, but the exterior corner 17 of the L-shaped steel rail 10 is also cushioned. This aspect is considered useful mainly in the reduction of severity and incidence of injury from accidental collision of a part of the body displaced upward with respect to the exterior corner 17 of the L-shaped steel rail 10.

Although this sort of collision is not uncommon with the feet of adults this type of collision is typically without serious consequence in comparison with the collision of a child's head during a fall with the outward face 15 and particularly the top edge 13 of the vertical leg 11 which is considered to be characterized by downward displacement of the portion of the body concerned. Hence while the safety device 20 depicted in FIG. 5 is considered to have additional protection against injury and possesses excellent attachment to the L-shaped steel rail 10, this particular embodiment of the principles relating to the present invention could include rocking of the L-shaped steel rail 10 during solidification in the dip molding operation and is considered comparatively expensive. As suggested by FIG. 5, wherein the cross sectioning indicates use of synthetic resin or plastic as the material utilized, it is also considered that molding utilizing an exterior foam for the case considered therein is also appropriate. The suitable liquid adhesive material utilized in dip molding, moreover, might constitute a synthetic resin or plastic.

It is further considered that extrusion provides an economic method of manufacture so that even the cost of providing an adhesive layer 30, which fixedly attaches the safety device 20 to an L-shaped steel rail 10 in a manner considered substantially as good as that provided by dip molding, is more economical than dip molding. For an extrusion a foam plastic such as polyurethane or polyethylene is recommended. Both materials, either of an open cell or closed cell type, possess good impact absorption characteristics and excellent recovery.

A safety device 20 in accordance with the principles relating to the present invention may possess a channel between the substantially parallel and spaced apart exterior and interior portions 25, 26 which is dimensioned to fit about the vertical leg 11 and which may be of sufficient height to provide attachment to said vertical leg 11 without the assistance of any other element. The desirable physical characteristics, especially with regard to the desired width of the channel, have been thoroughly discussed in the co-pending U.S. application Ser. No. 08/839,396, now U.S. Pat. No. 5,867,853. This discussion is based upon the fact, mentioned earlier, that the vertical leg is of substantially invariable thickness of approximately eleven hundredths of an inch (0.11") and that it is considered desirable to contact both the outward and inward faces 15, 19 with the opposed faces of a channel.

The above cited co-pending application for patent further discussed an embodiment of the principles relating to the invention claimed therein which possesses an interior corner 27 and a lower portion 22 which exerted contact upon the bottom face 16 of the horizontal leg 12 of an L-shaped steel rail 10. This contact can be maintained, as discussed therein, by the same configuration even with the different sizes of L-shaped steel rails typically utilized in the construction of modern type steel bed frames.

Figure 6:
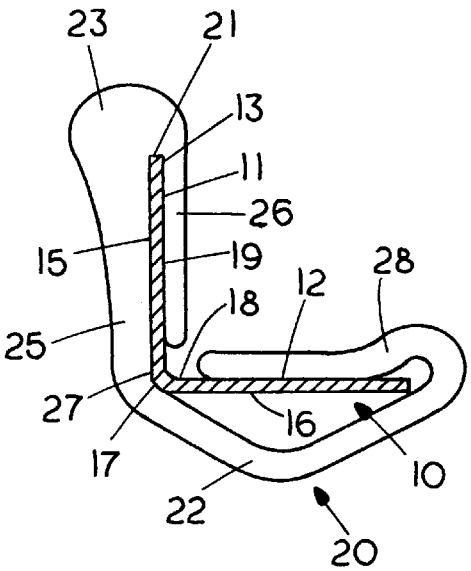
FIG. 6 is an end view of an embodiment of the principles relating to the present invention which possesses a lower gripping portion above the horizontal leg of an L-shaped rail which is shown in a cross sectional view.
Figure 7:
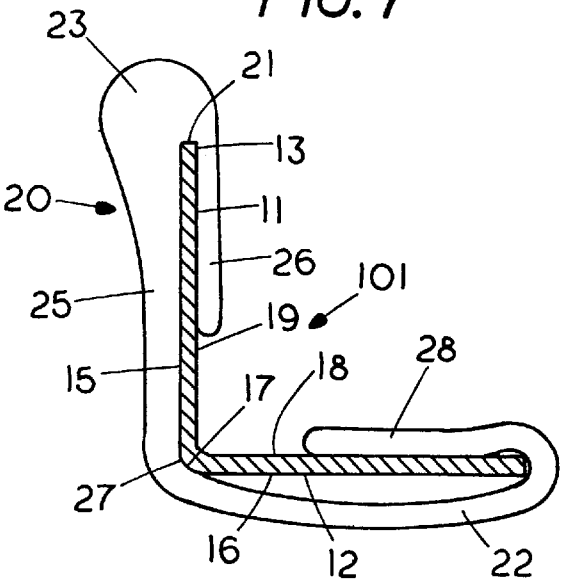
FIG. 7 is an end view of the embodiment of the principles relating to the present invention depicted in FIG. 6 attached to a large rail which is shown in a cross sectional view.

The embodiment of the principles relating to the present invention depicted in FIGS. 6 & 7 is similarly shown in these two figures as fitting, respectively, either a standard small size L-shaped steel rail 10 or a standard large size L-shaped steel rail 101, while further obtaining contact not necessarily with the bottom face 16 but with the upper face 18 of the horizontal leg 12 with a lower gripping portion 28. It is considered desirable in this case to extrude the configuration with an acute angle between the lower gripping portion 28 and the lower portion 22 and with an obtuse angle between laterally adjacent parts of the lower portion 22 as depicted in FIG. 6 so that contact with the upper surface 18 of the horizontal leg 12 will be maintained when located upon a large L-shaped steel rail 101 as depicted in FIG. 7.

It is noted with regard to the embodiment of the principles relating to the present invention depicted in FIGS. 6 & 7 that the attachment of the safety device 20 depicted therein to the L-shaped steel rail 10, 101 of an already standing bed may likely present some difficulty in that the majority of the bed is likely resting upon the upper surface 18 of the horizontal leg 12. The element of bed frame structure concerned might be displaced upward during installation in this case and the difficulty is not considered insurmountable. In the case wherein the safety device 20 is attached during manufacture of the bed frame, however, there is no difficulty at all and the weight of the subsequently disposed element of the bed frame concerned upon the upper face 18 of the horizontal leg 12 will secure the lower gripping portion 28 in position thus substantially obtaining, with regard to the purposes of the present invention, an attachment of the safety device 20 to the bed frame which also allows removal of the device 20 from the L-shaped steel rail 10.

Hence the embodiment of the principles relating to the present invention depicted in FIGS. 6 & 7 possesses mechanism of attachment to the L-shaped steel rail 10, as do all other such embodiments. The adhesive layer 30 is perhaps the most obvious such mechanism but dip molding also possesses mechanism of attachment which are inherent to the process as connoted by the use of the term 'suitable liquid elastic material' by which the quality of adhesion to the rail 10 is expressly asserted. This material may also, when dry, possess satisfactory impact absorption characteristics. Natural rubber, latex or otherwise, has been mentioned earlier as an appropriate material. Liquid elastic material sold currently for dipping the handles of tools into is considered suitable.

The manufacture of any of the configurations depicted in the drawings attached hereto or any variation of the elements discussed above is considered to be well within the ability of one practiced in the art. Because the configuration may be substantially uniform extrusion is recommended as the most economic method known. But molding, by any method, to form the safety device 20 is also considered to be a perfectly satisfactory approach to manufacture.

In operation, the present invention includes minimizing or preventing a rail 10 from damaging an object. The rail 10 may include a top edge 13 and a face surface 15. The rail 10 is shielded minimizing a force of impact between an object and the steel rail 10. The shielding may protect or minimize impact of an object with either the top edge 13 and/or the face surface 15. The shielding may include securing a safety device 20 to the rail 10. This shielding may be performed via a deflecting device, a compressible member, any combination thereof, or other suitable mechanism or method of shielding. Such securement may be selective or permanent and may be any suitable form of securement found in the art of attaching two objects together.

The foregoing is considered exemplary with regard to what is considered instructive to one practiced in the art in obtaining what is considered the best manner of making and utilizing an embodiment in accordance with the principles relating to the present invention and is not to be considered in any manner restrictive of the scope of the subject matter encompassed by the property granted by Letters Patent. For example, substantial discussion has been directed to L-shaped steel rails with an upper edge. The edge may be directed downward such as is found on a day bed, the material may be other metal, including alloys, plastics or other suitable rail material. The protective device has also been substantially described as a compressible member, although a deflecting member, especially with a naturally lubricious surface or mechanism for increasing the area of the upper edge will also provide suitable shielding. Although the present invention has been described with reference to preferred embodiments, workers skilled in the art will recognize changes may be made in form and detail without departing from the spirit and scope of the invention.

I claim:

1. A safety device, comprising:

an L-shaped steel rail of a bed frame, having a top edge and a face surface;

a protective member, having an interior portion, an upper portion and an exterior portion, the exterior portion being smaller in thickness than the upper portion and the exterior portion being larger in thickness than the interior portion, the protective member being disposed at least in part above the top edge of the steel rail, the protective member being designed of a compressible material suitable for spreading a force of impact, the member minimizing damage to an object impacting against the top edge of the steel rail, and the protective member minimizing damage to an object impacting against the face surface; and means for attaching the protective member to the steel rail.

2. A safety device, comprising:

a metal rail of a bed comprising a top edge and an outward face; and a protective member, having an upper portion disposed adjacent the top edge of the rail and an exterior portion overlying at least a portion of the outward face of the rail, the exterior portion being smaller in thickness than the upper portion, the protective member shielding at least a portion of the rail, the protective member minimizing damage to an object impacting against the rail.

3. The device of claim 2 wherein the protective member is formed of a compressible material.

4. The device of claim 3 wherein the material is foam.

5. The device of claim 2 wherein the rail is an L-shaped steel rail.

6. The device of claim 2 wherein the upper portion of the protective member is disposed above the top edge of the rail.

7. The device of claim 2 wherein the protective member is designed to spread a force of impact.

8. The device of claim 2 wherein the protective member is formed of plastic.

9. The device of claim 2 wherein the protective member is formed of an elastomeric material.

10. The device of claim 2 further comprising:

means for attaching the protective member to the rail.

11. The device of claim 10 wherein the attaching means selectively attaches the protective member to the rail.

12. The device of claim 10 wherein the attaching means is a layer of adhesive.

13. The device of claim 10 wherein the attaching means is at least one hook-shaped portion of the protective member.

14. The device of claim 2 further comprising:

an object impacting against the rail and protective member combination.

15. A method of preventing damage, comprising:

providing a steel rail of a bed frame, having a top edge and a face surface; and providing padding for the steel rail, the padding having an exterior portion, an upper portion and an interior portion, the exterior portion being thicker than the interior portion the upper portion being thicker than the exterior portion; and shielding the steel rail with the padding, minimizing a force of impact between an object and the steel rail.

16. The method of claim 15 further comprising the steps of:

providing an object; and shielding the face surface of the steel rail, minimizing a force of impact between the object and the steel rail.

17. The method of claim 15 further comprising the step of:

impacting the steel rail with an object.

18. The method of claim 15 further comprising the step of:

securing the impact protecting member to the steel rail.

19. The method of claim 15 wherein the step of securing provides a selective securement.

* * * * *